US012797951B2

(12) United States Patent
Imano et al.

(10) Patent No.: US 12,797,951 B2
(45) Date of Patent: Nov. 17, 2026

(54) ALLOY POWDER MANUFACTURING APPARATUS

(71) Applicant: TOKIN CORPORATION, Shiroishi (JP)

(72) Inventors: Yosuke Imano, Sendai (JP); Masato Kuno, Sendai (JP); Akiri Urata, Sendai (JP)

(73) Assignee: TOKIN CORPORATION, Miyagi (JP)

( * ) Notice: Subject to any disclaimer, the term of this patent is extended or adjusted under 35 U.S.C. 154(b) by 392 days.

(21) Appl. No.: 18/576,860

(22) PCT Filed: Jul. 5, 2022

(86) PCT No.: PCT/JP2022/026746
§ 371 (c)(1),
(2) Date: Jan. 5, 2024

(87) PCT Pub. No.: WO2023/282268
PCT Pub. Date: Jan. 12, 2023

(65) Prior Publication Data

US 2024/0351102 A1 Oct. 24, 2024

(30) Foreign Application Priority Data

Jul. 6, 2021 (JP) ..... 2021-112002

(51) Int. Cl.
*B22F 9/08* (2006.01)
*B22F 9/10* (2006.01)

(52) U.S. Cl.
CPC ..... *B22F 9/08* (2013.01); *B22F 9/10* (2013.01); *B22F 2009/0812* (2013.01)

(58) Field of Classification Search
CPC ..... B22F 9/08
See application file for complete search history.

(56) References Cited

U.S. PATENT DOCUMENTS 4,405,535 A 9/1983 Raman et al.
7,780,757 B2 8/2010 Furuya
(Continued)

FOREIGN PATENT DOCUMENTS

CN 1753749 A 3/2006
CN 104084596 A 10/2014
(Continued)

OTHER PUBLICATIONS

English machine translation of Jp H08-209208 A (Year: 1996).*
(Continued)

*Primary Examiner* — Jophy S. Koshy
*Assistant Examiner* — Joshua S Carpenter
(74) *Attorney, Agent, or Firm* — Holtz, Holtz & Volek PC

(57) ABSTRACT

An alloy powder manufacturing apparatus includes a substrate, at least one nozzle, and at least one alloy supply part. The nozzle forms a liquid film having a predetermined thickness by supplying a high-speed fluid formed from a cooling liquid onto the substrate in such a manner as to apply a predetermined acceleration to the liquid film along a thickness direction. The alloy supply part supplies a molten alloy to the liquid film without dividing same into a size equal to or less than a predetermined thickness. Particles are formed by dividing the molten alloy into a size equal to or less than the predetermined thickness by means of the high-speed fluid, and the particles are cooled in a condition in which the particles are retained in the liquid film by means of the predetermined acceleration and kept in contact with the high-speed fluid.

15 Claims, 8 Drawing Sheets

(56) References Cited

U.S. PATENT DOCUMENTS

| | | | | |
|---|---|---|---|---|
| 2010/0043927 | A1 | 2/2010 | Makino | |
| 2013/0278366 | A1 | 10/2013 | Makino | |
| 2020/0261981 | A1 * | 8/2020 | Yamagata | B22F 1/065 |

FOREIGN PATENT DOCUMENTS

| | | | | |
|---|---|---|---|---|
| CN | 109382521 | A | 2/2019 | |
| EP | 0543017 | A1 * | 5/1993 | B22F 9/082 |
| JP | S6455308 | A | 3/1989 | |
| JP | H01049769 | B2 | 10/1989 | |
| JP | H02122009 | A | 5/1990 | |
| JP | H08209208 | A * | 8/1996 | |
| JP | 4584350 | B2 | 11/2010 | |

OTHER PUBLICATIONS

International Search Report (ISR) (and English language translation thereof) dated Aug. 16, 2022, issued in International Application No. PCT/JP2022/026746.

Written Opinion dated Aug. 16, 2022, issued in International Application No. PCT/JP2022/026746.

Japanese Office Action (and an English language translation thereof) dated Jun. 4, 2025, issued in counterpart Japanese Application No. 2021-112002.

Chinese Office Action (and an English language translation thereof) dated Aug. 14, 2026, issued in counterpart Chinese Application No. 202280047804.X.

* cited by examiner

ALLOY POWDER MANUFACTURING APPARATUS

TECHNICAL FIELD

This invention relates to an alloy powder manufacturing apparatus for manufacturing alloy powder.

BACKGROUND ART

For example, an existing method for manufacturing alloy powder is disclosed in Patent Document 1, the content of which is incorporated herein in its entirety by reference.

As disclosed in Patent Document 1, a water atomization method and a gas atomization method are known as typical manufacturing methods of alloy powder.

PRIOR ART DOCUMENT(S)

Patent Document(s)

Patent Document 1: JP4584350B

SUMMARY OF INVENTION

Technical Problem

However, an alloy powder manufactured by a water atomization method or a gas atomization method often varies in quality.

It is therefore an object of the present invention to provide an alloy powder manufacturing apparatus suitable for a new manufacturing method of an alloy powder which replaces the water atomization method and the gas atomization method.

Solution to Problem

The existing typical water atomization method or gas atomization method is a rapid cooling atomization method in which water or gas is used to divide molten alloy so that particles are formed and thereafter coolant liquid such as coolant water is used to rapidly cool the particles. However, the particles have different cooling rates from each other dependent on sizes of the divided particles. In addition, the divided particles will fall on different positions from each other with different velocities from each other. Therefore, the divided particles are cooled in atmosphere for different times from each other until they fall on the coolant liquid. The particles vary in quality because of the various reasons described above.

The present invention solves the aforementioned problem by substantially simultaneously performing division and cooling of the molten alloy. More specifically, according to the present invention, a certain mass of the molten alloy, depending on which the molten alloy can be prevented from getting cooled, is supplied to a liquid film made of coolant liquid. Thereafter, the molten alloy is divided into particles by the liquid film, and each particle is also cooled by the liquid film. According to the aforementioned manufacturing method, the divided particles are cooled similarly to each other, and thereby homogeneous particles can be obtained.

The alloy powder manufacturing apparatus of the present invention is an apparatus which is suitable for the aforementioned manufacturing method. More specifically, the present invention provides the alloy powder manufacturing apparatus described below.

An aspect of the present invention provides an alloy powder manufacturing apparatus comprising a base portion, at least one nozzle and at least one alloy supplying portion. The nozzle supplies high speed fluid made of coolant liquid onto the base portion and forms a liquid film with a predetermined thickness so that a predetermined acceleration is applied to the liquid film along a thickness direction. The alloy supplying portion supplies molten alloy to the liquid film without dividing the molten alloy into a size equal to or less than the predetermined thickness. The high-speed fluid divides the molten alloy into a size equal to or less than the predetermined thickness to form particles, and the predetermined acceleration keeps the particles in the liquid film so that the particles are continuously in contact with the high-speed fluid and are cooled thereby.

Advantageous Effects of Invention

A homogeneous alloy powder can be formed by using the alloy powder manufacturing apparatus of an aspect of the present invention. Thus, an aspect of the present invention provides an alloy powder manufacturing apparatus suitable for a new manufacturing method of an alloy powder which replaces the water atomization method and the gas atomization method.

An appreciation of the objectives of the present invention and a more complete understanding of its structure may be had by studying the following description of the preferred embodiment.

DESCRIPTION OF EMBODIMENTS

First Embodiment

Figure 1:
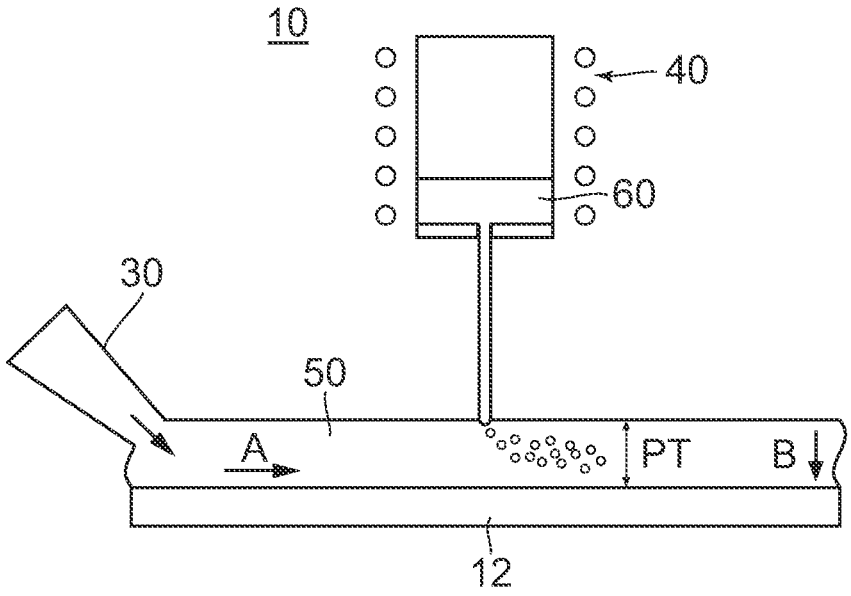
FIG. 1 is a view showing an alloy powder manufacturing apparatus according to a first embodiment of the present invention.

Referring to FIG. 1, an alloy powder manufacturing apparatus 10 according to a first embodiment of the present invention comprises a base portion 12, a nozzle 30 and an alloy supplying portion 40.

The nozzle 30 supplies high-speed fluid made of coolant liquid such as coolant water onto the base portion 12 with high pressure and forms a liquid film 50 with a predetermined thickness PT on the base portion 12. The high-speed fluid is the coolant liquid which flows at high speed along a direction indicated by an arrow A. The alloy powder manufacturing apparatus 10 is configured so that a predetermined acceleration is applied to the liquid film 50 along a direction indicated by an arrow B. Thus, the nozzle 30 forms the liquid film 50 so that the predetermined acceleration is applied to the liquid film 50 along a thickness direction of the liquid film 50. The number of the nozzle 30 of the present embodiment is two. However, the present invention is not limited thereto. For example, the number of the nozzle 30 may be one, three or more. Thus, the alloy powder manufacturing apparatus 10 should comprise at least one nozzle 30. The at least one nozzle 30 may include a plurality of the nozzles 30.

The alloy supplying portion 40 supplies molten alloy 60 to the liquid film 50 without dividing the molten alloy 60 into a size equal to or less than a predetermined thickness PT. Thus, in the present embodiment, a certain mass of the molten alloy 60 is supplied to the liquid film 50 without being divided unlike an existing rapid cooling atomization method in which particles are formed by dividing the molten alloy 60 and then rapidly cooled by the liquid film 50. The number of the alloy supplying portion 40 of the present embodiment is one. However, the present invention is not limited thereto. For example, the number of the alloy supplying portion 40 may be two or more. Thus, the alloy powder manufacturing apparatus 10 should comprise at least one alloy supplying portion 40. The at least one alloy supplying portion 40 may include a plurality of alloy supplying portions 40.

When a certain mass of the molten alloy 60 is supplied to the liquid film 50 without being divided, the molten alloy 60 is divided into a size equal to or less than the predetermined thickness PT by the liquid film 50 made of the high-speed fluid, and the particles are formed. When the particles are brought into contact with the liquid film 50, the particles are cooled by the coolant liquid. Meanwhile, the coolant liquid around the particles is instantaneously evaporated. However, the liquid film 50 of the present embodiment has the predetermined acceleration. Even after the coolant liquid around the particles is evaporated, the predetermined acceleration keeps the particles being pressed against and in contact with the coolant liquid of the high-speed fluid. Summarizing the explanation described above, in the alloy powder manufacturing apparatus 10, the high-speed fluid divides the molten alloy 60 into a size equal to or less than the predetermined thickness PT to form the particles, and the predetermined acceleration keeps the particles in the liquid film 50 so that the particles are continuously in contact with the high-speed fluid and are cooled thereby.

An existing rapid cooling atomization method has a problem of being costly. For example, large equipment is often required. In addition, high-pressure gas facilities and gas expense are required. Moreover, because the divided particles are considerably cooled before their fall on a liquid film, there is a problem that cooling rate of the particles after fall on the liquid film is lowered. In contrast, in the alloy powder manufacturing apparatus 10 of the present embodiment, the molten alloy 60 is substantially simultaneously divided and cooled in the liquid film 50, and thereby difference in the cooling rate among the particles is reduced. As a result, homogeneous particles can be obtained.

In a situation in which the divided particles insufficiently cooled in the liquid film 50, the particles would hit the base portion 12 which is located at the bottom of the liquid film 50 before they completely solidify. The thus-hit particles might have irregular shapes. As a solution of this problem in the present embodiment, the predetermined acceleration in the thickness direction of the liquid film 50, or in the direction along the arrow B, is designed to be $2.0\times10^4$ G or more, and the predetermined thickness PT of the liquid film 50 is designed to be 0.1 mm or more. Sufficient cooling ability cab be obtained under the condition where the predetermined acceleration is $2.0\times10^4$ G or more. The irregular shape particles can be reduced in number under the condition where the predetermined thickness PT of the liquid film 50 is 0.1 mm or more since the divided particles, or droplets, will not hit the base portion 12 before solidification. As described above, according to the present embodiment, the particles solidify before they fall on the base portion 12 located at the bottom of the liquid film 50 and have sphere shapes or almost sphere shapes. The thus-obtained particles are sufficiently uniform even in their shapes. The aforementioned manufacturing method of an alloy powder according to the present embodiment is particularly suitable to manufacture a soft magnetic powder.

A maximum distance between the alloy supplying portion 40 and the liquid film 50 is preferred to be 300 mm or less. In detail, the alloy supplying portion 40 is formed with a supplying opening through which the molten alloy 60 is supplied to the liquid film 50. A maximum distance between the supplying opening of the alloy supplying portion 40 and the liquid film 50 is preferred to be 300 mm or less. In an instance where the distance between the alloy supplying portion 40 and the liquid film 50 is too long, the molten alloy 60 is cooled to some extent until it falls on the liquid film 50 and the effect which is obtained as a result of the rapid cooling of the particles by the liquid film 50 is reduced. In addition, the speed of the molten alloy 60 is increased at the time when it falls on the liquid film 50, and the molten alloy 60 might not be properly divided by the liquid film 50.

For example, the base portion 12 may be an inner wall 22 of a drum, and the inner wall 22 of the drum may have, at least in part, curvature so that the predetermined acceleration is generated in the liquid film 50. When the coolant liquid is continuously supplied from the nozzle 30 onto the thus-formed base portion 12, a centrifugal acceleration directed along the thickness direction of the base portion 12, or directed toward the inner wall 22 of the drum, is generated at least at the part which has the curvature. This centrifugal acceleration may be used as the predetermined acceleration.

In other words, the predetermined acceleration may be the centrifugal acceleration which is generated by using the curvature of the inner wall 22 of the drum and is directed toward the inner wall 22. The aforementioned curvature is preferred to have a curvature radius of 100 mm or less for obtaining a required predetermined acceleration. In an instance where the centrifugal acceleration is used as the predetermined acceleration, the alloy supplying portion 40 supplies the molten alloy 60 to the high-speed fluid at an upstream side of a part of the inner wall 22 of the drum which has the curvature, or a part at which the centrifugal acceleration is generated. The alloy powder can be efficiently and continuously cooled by an apparatus with a simple structure by using the centrifugal acceleration as the predetermined acceleration.

The coolant liquid supplied from the nozzle 30 is preferred to have an initial velocity of 80 m/s or more, and the predetermined acceleration is preferred to be $1.0\times10^7$ G or less. When the initial velocity of the coolant liquid is less than 80 m/s, the liquid film 50 has poor ability to divide the molten alloy 60. Such poor ability makes the divided droplets in the liquid film 50 large, and the droplets are more frequently deformed during cooling. As a result, excessively large particles each having a long shape are increased in number. Thus, the irregular shape particles are easily formed. When the initial velocity of the coolant liquid is 80 m/s or more, sufficient ability to divide the molten alloy 60 can be obtained, and thereby the particles each having a sphere shape or an almost sphere shape can be obtained.

In particular, when the coolant liquid supplied from the nozzle 30 has an initial velocity of 100 m/s or more, the particles are made extremely fine, and amorphous feature and magnetic characteristics thereof are improved. Accordingly, the initial velocity of the coolant liquid is further preferred to be 100 m/s or more. However, in an instance where the initial velocity of the coolant liquid supplied from the nozzle 30 exceeds 800 m/s, although fine particles can be obtained, particles of thread-like shapes are increased in number. Accordingly, the initial velocity of the coolant liquid is further preferred to be 800 m/s or less.

In addition to the condition about the initial velocity of the coolant liquid, from a viewpoint of obtaining sufficient ability to divide the molten alloy 60, the coolant liquid is preferred to have a velocity of 40 m/s or more at a position where the molten alloy 60 falls.

The predetermined acceleration of the liquid film 50 is further preferred to be $3.0\times10^4$ G or more. When the predetermined acceleration is made high, the cooling ability can be improved. The thus-achieved high cooling ability has advantage that even an alloy having a composition with low amorphous forming capability can be formed with amorphous phase.

The predetermined thickness PT is preferred to be 0.8 mm or more. When the thickness of the liquid film 50 is 0.8 mm or more, the divided droplets spread over a wide range in the liquid film 50, and thereby the divided droplets can be prevented from colliding with each other to be shaped into irregular shapes.

When the molten alloy 60 is supplied to the liquid film 50, the molten alloy 60 is preferred to be supplied only to a predetermined area which is located on the liquid film 50 and has a diameter of 15 mm or less. In other words, the alloy supplying portion 40 is preferred to be arranged so that the alloy supplying portion 40 supplies the molten alloy 60 only to the predetermined area which is located on the liquid film 50 and has a diameter of 15 mm or less. When the molten alloy 60 is supplied onto a region located within the predetermined area as described above, the alloy powder can be made stable in quality, and a structure with the base portion 12 which is used for forming the liquid film 50 can be reduced in size. The diameter of the predetermined area is further preferred to be 10 mm or less.

Second Embodiment

Figure 2:
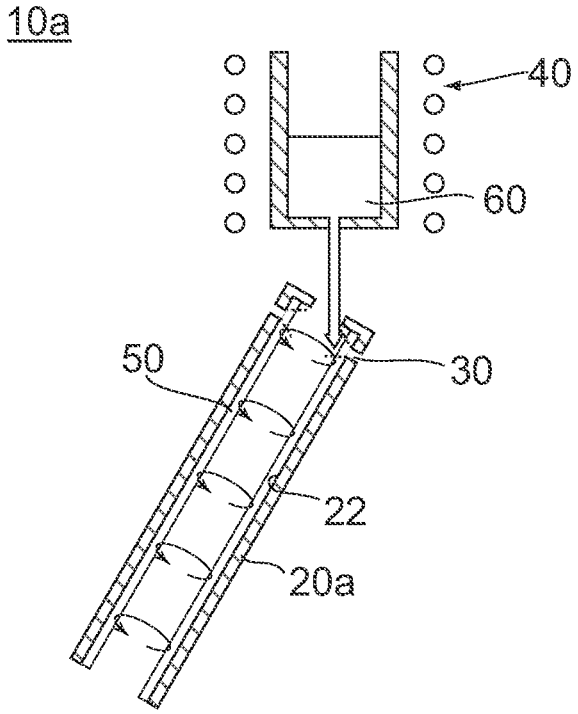
FIG. 2 is a view showing an alloy powder manufacturing apparatus according to a second embodiment of the present invention.

Referring to FIG. 2, an alloy powder manufacturing apparatus 10*a* according to a second embodiment of the present invention comprises a drum 20*a*, the nozzles 30 and the alloy supplying portion 40. In the explanation described below, elements similar to those of the alloy powder manufacturing apparatus 10 according to the first embodiment will be referred to by the similar reference signs shown in figures, and specific explanation thereof will not be described.

The drum 20*a* has a cylindrical shape except for a part provided with the nozzles 30 and the opening of the entrance through which the molten alloy 60 is supplied. Thus, an inner wall 22 of the drum 20*a* has curvature depending on an inner diameter of the drum 20*a*. When the coolant liquid is supplied from the nozzle 30 and forms the liquid film 50 having the predetermined thickness PT on the inner wall 22 of the drum 20*a* so that the inner wall 22 of the drum 20*a* works as the base portion 12 of the aforementioned first embodiment, the centrifugal acceleration directed toward the inner wall 22 of the drum 20*a* is generated in the liquid film 50. In detail, the liquid film 50 made of the coolant liquid supplied from the nozzle 30 onto the inner wall 22 of the drum 20*a* flows downstream toward an exit of the drum 20*a* while swirling at high speed. The liquid film 50 receives the centrifugal acceleration along the thickness direction because of this high-speed swirl. In the present embodiment, this centrifugal acceleration is used as the predetermined acceleration described in the first embodiment. According to the present embodiment, the alloy powder can be efficiently and continuously cooled by an apparatus with a simple structure.

The molten alloy 60 supplied from the alloy supplying portion 40 falls in the drum 20*a* because of its own weight. An angle along which the molten alloy 60 is supplied to the liquid film 50 can be adjusted by changing the inclination of the drum 20*a*.

The drum 20*a* is preferred to have an inner diameter which is 10 mm or more but is 100 mm or less, and is further preferred to have an inner diameter which is 20 mm or more but is 60 mm or less. When the inner diameter of the drum 20*a* is made small, the centrifugal acceleration is made large, and thereby amorphous feature of the manufactured alloy powder is improved. The aforementioned effect is made profound by making the inner diameter of the drum 20*a* be 100 mm or less. For example, even when the molten alloy 60 has a composition in which Fe amount is 80 at % or more, particles having good amorphous feature can be formed. When the inner diameter of the drum 20*a* is 60 mm or less, the amorphous feature of the manufactured alloy powder is further improved. As the inner diameter of the drum 20*a* is made smaller, the amorphous feature is more improved. However, actually, when the inner diameter is less than 10 mm, the molten alloy 60 cannot be easily supplied into the drum 20*a*. Accordingly, the inner diameter of the drum 20*a* is preferred to be 10 mm or more. The inner diameter of the drum 20*a* is preferred to be 20 mm or more from a viewpoint of more stably supplying the molten alloy 60 to the liquid film 50.

In a process in which the molten alloy 60 is supplied to the liquid film 50, the molten alloy 60 can be stably supplied by intersecting the liquid film 50 with a supplying angle of the molten alloy 60, or an angle along which the molten alloy 60 flows. The particles can be made fine by enlarging the supplying angle of the molten alloy 60 relative to the liquid film 50. From the aforementioned viewpoint, the supplying angle of the molten alloy 60 relative to the liquid film 50 is preferred to be 10° or more but to be 90° or less. In other words, the alloy supplying portion 40 is preferred to be arranged so that the alloy supplying portion 40 supplies the molten alloy 60 to the liquid film 50 along a direction which makes an angle which is 10° or more but is 90° or less relative to the liquid film 50.

Explaining the relation between the drum 20*a* and the alloy supplying portion 40, when the short diameter of an entrance of the drum 20*a* is referred to as "Rmin", and the distance between the alloy supplying portion 40 and the entrance of the drum 20*a* is referred to as "D", the ratio of D relative to Rmin, or D/Rmin, is preferred to be 50 or less, wherein the units of both Rmin and D are "mm". Thus, D (mm)/Rmin (mm) is preferred to be 50 or less. D (mm) is a distance between the supplying opening of the alloy supplying portion 40 which supplies the molten alloy 60 and the entrance through which the molten alloy 60 is supplied. Rmin (mm) is the short diameter of the entrance through which the molten alloy 60 is supplied. When the distance between the alloy supplying portion 40 and the entrance, or the entrance of the drum 20*a*, through which the molten alloy 60 is supplied is too long, the supplied molten alloy 60 will not linearly flow because of air resistance and environment but might flow while swinging or might flow while spreading.

Explaining the relation between the nozzles 30 and the alloy supplying portion 40, when the amount of the coolant liquid supplied from the nozzles 30 is referred to as "Aw", and the supplied amount of the molten alloy 60 from the alloy supplying portion 40 is referred to as "μm", the ratio of Am relative to Aw, or Am/Aw, is preferred to be one fifteenths or less, wherein the units of both Aw and Am are "kg/min". When the supplied amount of the molten alloy 60 is too large relative to the supplied amount of the coolant liquid, the molten alloy 60 might not be sufficiently divided and cooled.

Third Embodiment

Figure 3:
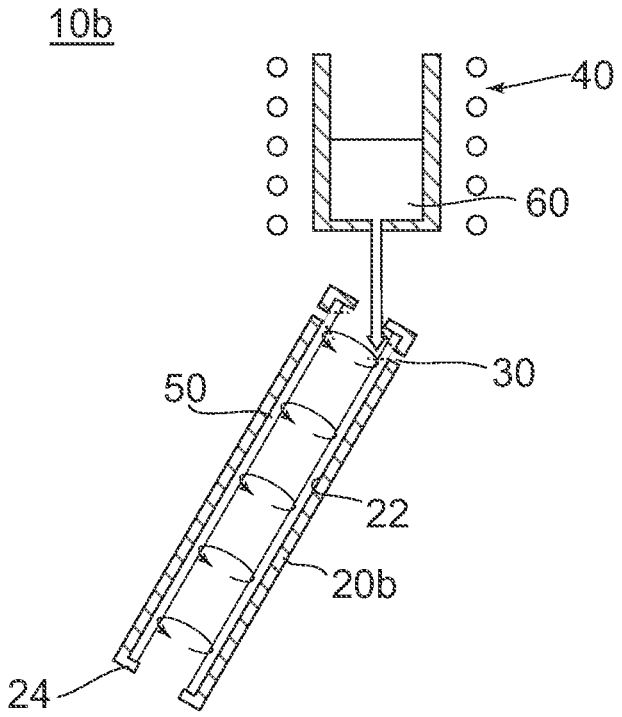
FIG. 3 is a view showing an alloy powder manufacturing apparatus according to a third embodiment of the present invention.

Referring to FIGS. 2 and 3, an alloy powder manufacturing apparatus 10*b* according to a third embodiment of the present invention is a modification of the alloy powder manufacturing apparatus 10*a* according to the second embodiment. In the explanation described below, elements similar to those of the alloy powder manufacturing apparatus 10*a* according to the second embodiment will be referred to by the similar reference signs shown in figures, and specific explanation thereof will not be described.

The alloy powder manufacturing apparatus 10*b* according to the present embodiment further comprises an exit cover 24. The exit cover 24 is provided on an exit of a drum 20*b*. The exit cover 24 is formed with an opening which has an inner diameter smaller than another inner diameter of the drum 20*b*. Thus, the exit cover 24 has a function which makes the exit of the drum 20*b* smaller. According to this function, a film thickness of the liquid film 50 can be made thick.

Fourth Embodiment

Figure 4:
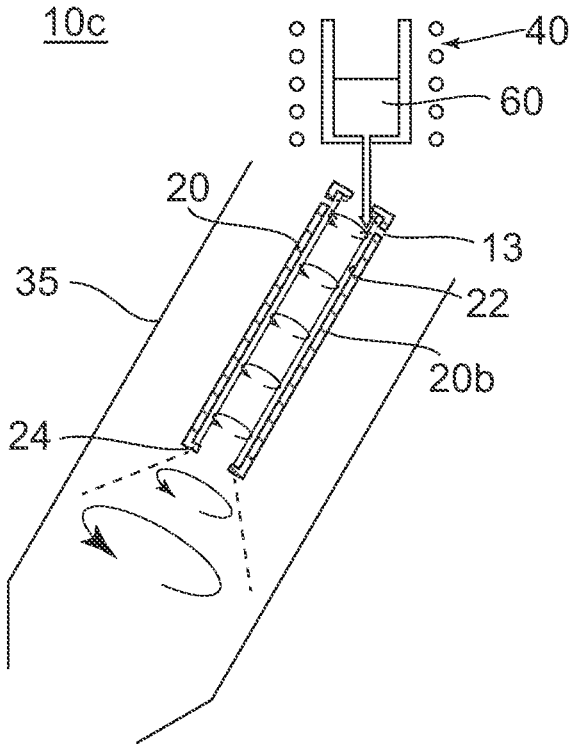
FIG. 4 is a view showing an alloy powder manufacturing apparatus according to a fourth embodiment of the present invention.

Referring to FIGS. 3 and 4, an alloy powder manufacturing apparatus 10*c* according to a fourth embodiment of the present invention is a modification of the alloy powder manufacturing apparatus 10*b* according to the third embodiment. In the explanation described below, elements similar to those of the alloy powder manufacturing apparatus 10*a* according to the second embodiment or the alloy powder manufacturing apparatus 10*b* according to the third embodiment will be referred to by the similar reference signs shown in figures, and specific explanation thereof will not be described.

The alloy powder manufacturing apparatus 10*c* according to the present embodiment further comprises a scatter prevention portion 35. The scatter prevention portion 35 has a cylindrical shape and covers around the drum 20*b*. The liquid film 50 of the present embodiment is the coolant liquid which swirls at high speed along the inner wall 22 of the drum 20*b*. The thus-swirling coolant liquid is powerfully discharged from the exit of the drum 20*b*. The particles moved by the coolant liquid tend to be scattered when the coolant liquid is discharged. The scatter prevention portion 35 of the present embodiment surrounds at least around the vicinity of the exit of the drum 20*b* and catches the particles discharged from the drum 20*b*. The discharged alloy powder is easily collected since the alloy powder manufacturing apparatus 10*c* according to the present embodiment comprises the scatter prevention portion 35.

The scatter prevention portion 35 of the present embodiment has a cylindrical shape. However, the shape and the structure of the scatter prevention portion 35 are not specifically limited, provided that the alloy powder can be easily collected. For example, the scatter prevention portion 35 does not need to surround the drum 20*b* except for the vicinity of the exit of the drum 20*b*. Thus, the scatter prevention portion 35 may surround at least the vicinity of the exit of the drum 20*b* so that the alloy powder is easily collected.

The alloy powder manufacturing apparatus 10*c* according to the present embodiment can be formed by adding the scatter prevention portion 35 to the alloy powder manufacturing apparatus 10*b* according to the third embodiment. However, the present invention is not limited thereto. For example, the scatter prevention portion 35 may be added to the alloy powder manufacturing apparatus 10*a* according to the second embodiment.

Fifth Embodiment

Figure 5:
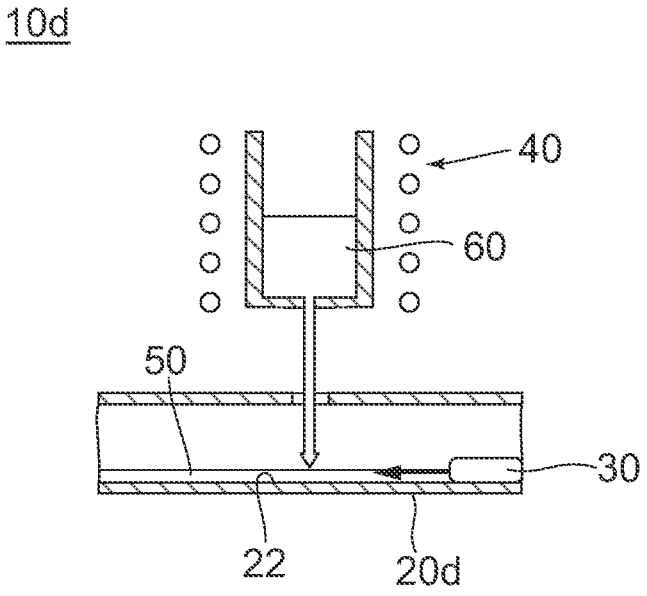
FIG. 5 is a view showing an alloy powder manufacturing apparatus according to a fifth embodiment of the present invention.

Referring to FIG. 5, an alloy powder manufacturing apparatus 10*d* according to a fifth embodiment of the present invention is a modification of the alloy powder manufacturing apparatus such as the alloy powder manufacturing apparatus 10*a* according to the second embodiment. In the explanation described below, elements similar to those of the alloy powder manufacturing apparatus 10*a* according to the second embodiment will be referred to by the similar reference signs shown in figures, and specific explanation thereof will not be described.

The alloy powder manufacturing apparatus 10*d* according to the present embodiment comprises a drum 20*d*. The drum 20*d* is arranged so that it horizontally extends. The molten alloy 60 is supplied from the alloy supplying portion 40 to the liquid film 50 through an opening which is formed in a part of the inner wall 22. The predetermined acceleration of the present embodiment is generated only by the gravity. However, the present invention is not limited thereto. For example, the predetermined acceleration may be increased by using another method.

Figure 6:
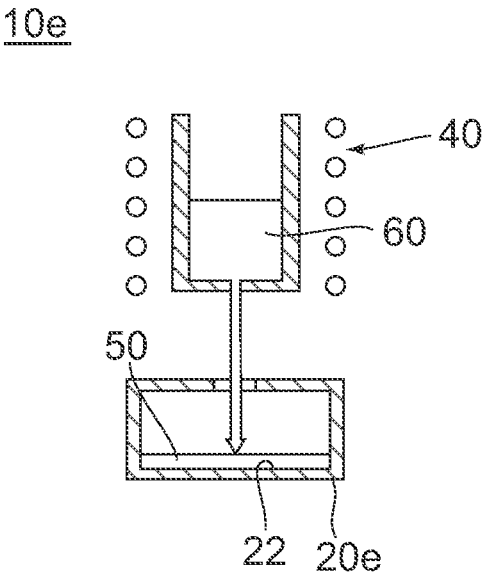
FIG. 6 is a view showing a modification of the alloy powder manufacturing apparatus of FIG. 5.
Figure 7:
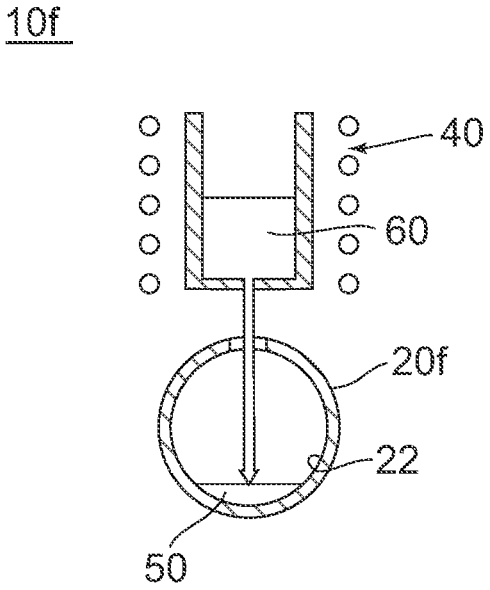
FIG. 7 is a view showing another modification of the alloy powder manufacturing apparatus of FIG. 5.

The shape of the cross-section of the drum 20*d* of the alloy powder manufacturing apparatus 10*d* is not specifically limited. For example, the shape of the cross-section of the drum 20*d* may be a rectangle similar to that of a drum 20*e* of an alloy powder manufacturing apparatus 10*e* shown in FIG. 6. The shape of the dross-section of the drum 20*d* may be a circle similar to that of a drum 20*f* of an alloy powder manufacturing apparatus 10*f* shown in FIG. 7.

Sixth Embodiment

Figure 8:
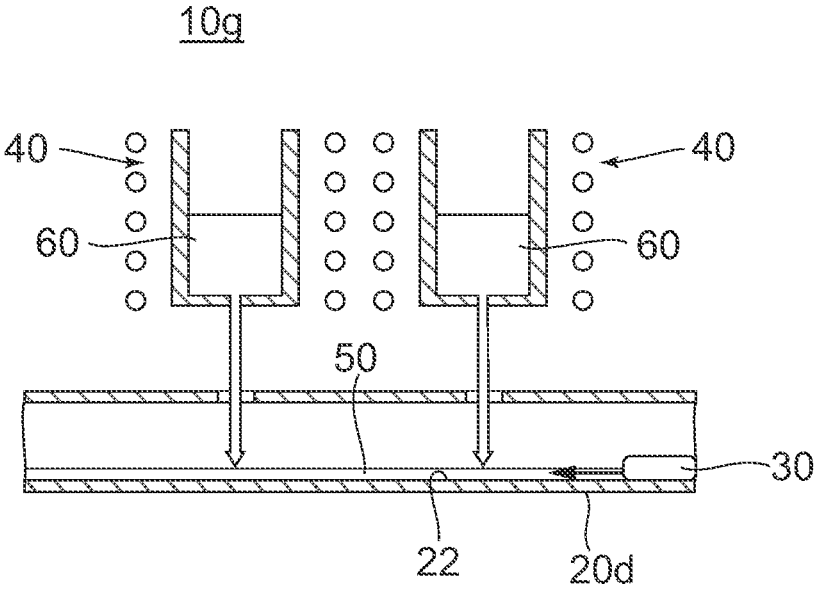
FIG. 8 is a view showing an alloy powder manufacturing apparatus according to a sixth embodiment of the present invention.

Referring to FIGS. 5 and 8, an alloy powder manufacturing apparatus 10*g* according to a sixth embodiment of the present invention is a modification of the alloy powder manufacturing apparatus 10*d* according to the fifth embodiment. In the explanation described below, elements similar to those of the alloy powder manufacturing apparatus 10*d* according to the fifth embodiment will be referred to by the similar reference signs shown in figures, and specific explanation thereof will not be described.

The alloy powder manufacturing apparatus 10*g* according to the present embodiment comprises two of the alloy supplying portions 40. The two alloy supplying portions 40 supply the molten alloy 60 onto two parts of the liquid film 50, respectively. The alloy powder manufacturing apparatus of the present invention may comprise a plurality of the alloy supplying portions 40 similarly to the present embodiment.

The alloy powder manufacturing apparatus 10*g* according to the present embodiment can be formed by adding one of the alloy supplying portions 40 to the alloy powder manufacturing apparatus 10*d* according to the fifth embodiment. However, the present invention is not limited thereto. For example, one or more of the alloy supplying portions 40 may be added to one of the alloy powder manufacturing apparatuses 10*a* to 10*c* according to the second to fourth embodiments.

Seventh Embodiment

Figure 9:
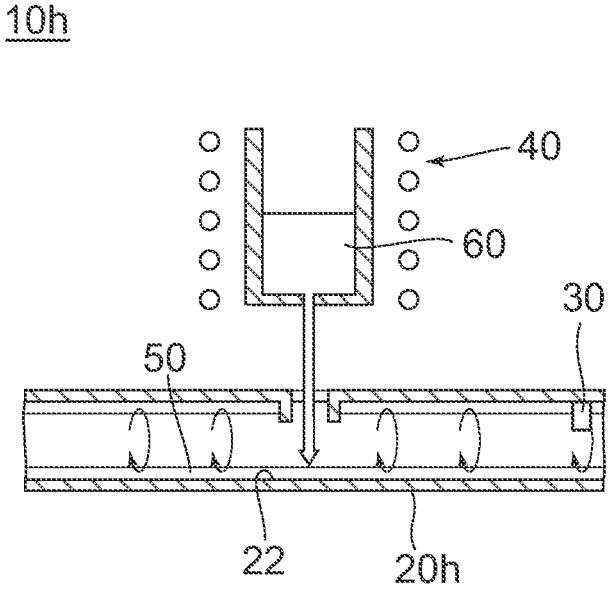
FIG. 9 is a view showing an alloy powder manufacturing apparatus according to a seventh embodiment of the present invention.

Referring to FIGS. 2, 5 and 9, an alloy powder manufacturing apparatus 10*h* according to a seventh embodiment of the present invention is a modification of the alloy powder manufacturing apparatus 10*a* according to the second embodiment and the alloy powder manufacturing apparatus 10*d* according to the fifth embodiment. In the explanation described below, elements similar to those of the alloy powder manufacturing apparatus 10*a* according to the second embodiment or the alloy powder manufacturing apparatus 10*d* according to the fifth embodiment will be referred to by the similar reference signs shown in figures, and specific explanation thereof will not be described.

The alloy powder manufacturing apparatus 10*h* according to the present embodiment comprises a drum 20*h*. The drum 20*h* has a roughly cylindrical shape and is arranged so that it horizontally extends. The coolant liquid is supplied from the nozzle 30 onto the inner wall 22 of the drum 20*h* and forms the liquid film 50. The predetermined acceleration of the present embodiment is mainly the centrifugal acceleration which is generated in the liquid film 50 by supplying the coolant liquid from the nozzle 30. The molten alloy 60 is supplied from the alloy supplying portion 40 to the liquid film 50 through an opening which is formed in a part of the inner wall 22 of the drum 20*h*.

Eighth Embodiment

Figure 10:
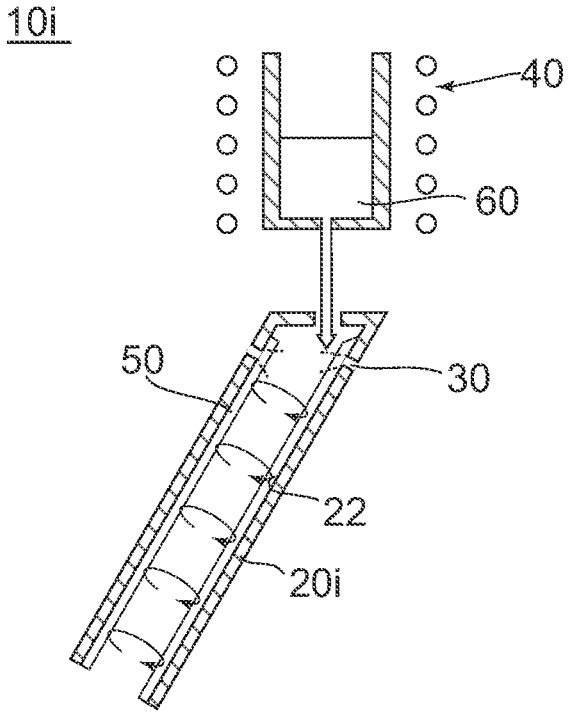
FIG. 10 is a view showing an alloy powder manufacturing apparatus according to an eighth embodiment of the present invention.

Referring to FIGS. 2 and 10, an alloy powder manufacturing apparatus 10*i* according to an eighth embodiment of the present invention is a modification of the alloy powder manufacturing apparatus 10*a* according to the second embodiment. In the explanation described below, elements similar to those of the alloy powder manufacturing apparatus 10*a* according to the second embodiment will be referred to by the similar reference signs shown in figures, and specific explanation thereof will not be described.

The alloy powder manufacturing apparatus 10*i* according to the present embodiment comprises a drum 20*i*. The drum 20*i* has a horizontally planar portion which is provided on an end portion thereof. The horizontally planar portion of the drum 20*i* is formed with an opening which works as an entrance of the drum 20*i*. Thus, according to the present embodiment, the entrance of the drum 20*i* can be defined not based on a plane perpendicular to the axial direction of the drum 20*i*. Accordingly, a distance between the alloy supplying portion 40 and the entrance of the drum 20*i* can be more accurately calculated, and influence of the environment to the molten alloy 60 is easily evaluated regardless of the arranged place and the inclination of the drum 20*i*.

Ninth Embodiment

Figure 11:
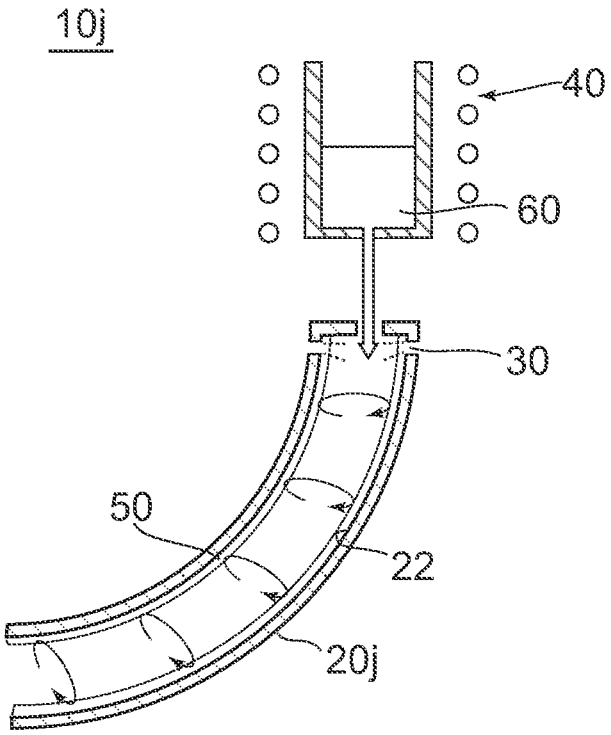
FIG. 11 is a view showing an alloy powder manufacturing apparatus according to a ninth embodiment of the present invention.

Referring to FIGS. 10 and 11, an alloy powder manufacturing apparatus 10*j* according to a ninth embodiment of the present invention is a modification of the alloy powder manufacturing apparatus 10*i* according to the eighth embodiment. In the explanation described below, elements similar to those of the alloy powder manufacturing apparatus 10*i* according to the eighth embodiment will be referred to by the similar reference signs shown in figures, and specific explanation thereof will not be described.

As shown in FIG. 11, the alloy powder manufacturing apparatus 10*j* according to the present embodiment comprises a drum 20*j*. When the drum 20*j* is cut along a plane which includes the center axis of the drum 20*j*, the inner wall 22 has an arc-like cross-section. Thus, the most part of the drum 20*j* has a shape which is like a part of a ring-like pipe. As can be seen from the present embodiment, the cross-section of the drum of the present invention can be flexibly designed to some extent.

Tenth Embodiment

Referring to FIGS. 2 and 12 to 14, an alloy powder manufacturing apparatus 10*k* according to a tenth embodiment of the present invention is a modification of the alloy powder manufacturing apparatus 10*a* according to the second embodiment. In the explanation described below, elements similar to those of the alloy powder manufacturing apparatus 10*a* according to the second embodiment will be referred to by the similar reference signs shown in figures, and specific explanation thereof will not be described.

Figure 12:
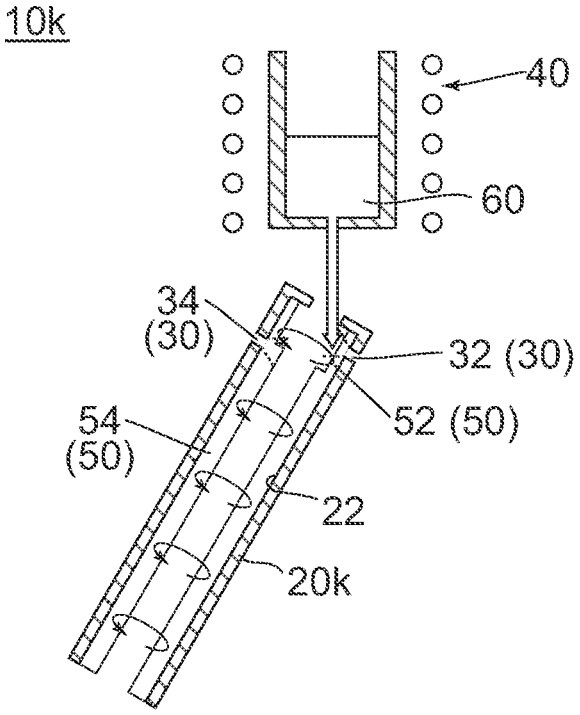
FIG. 12 is a view showing an alloy powder manufacturing apparatus according to a tenth embodiment of the present invention.
Figure 13:
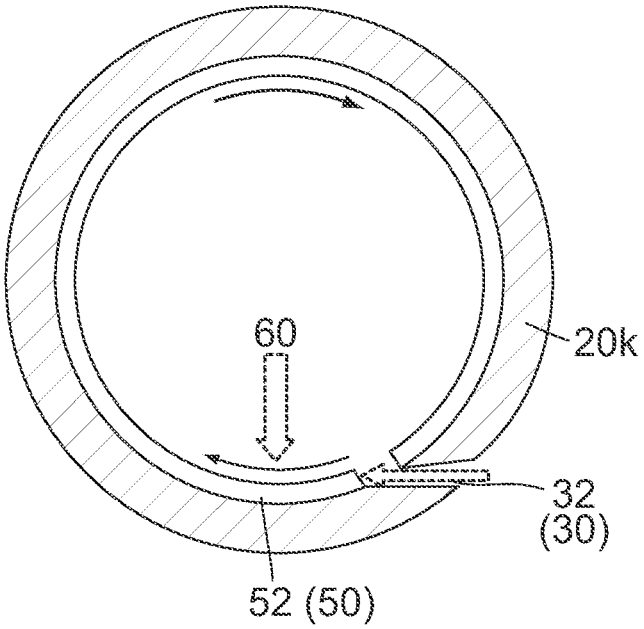
FIG. 13 is an end view showing a drum of the alloy powder manufacturing apparatus of FIG. 12, taken along a plane perpendicular to a central axis of the drum and including a first nozzle.
Figure 14:
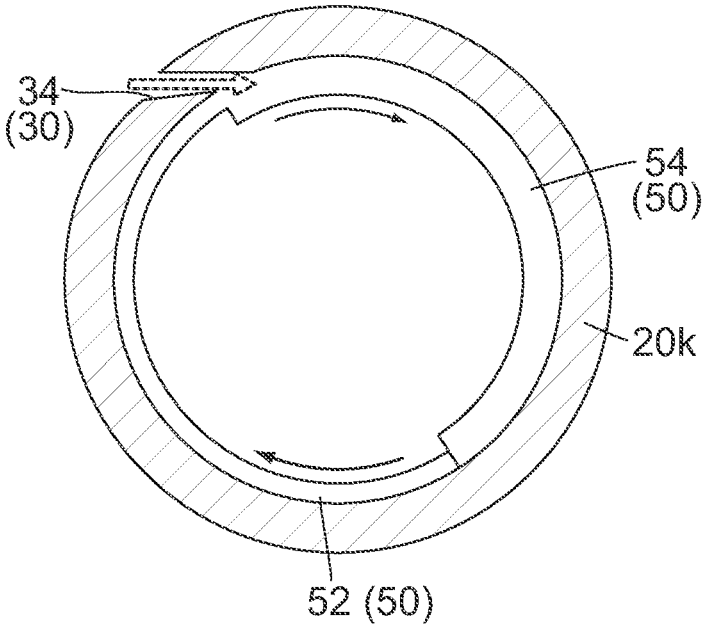
FIG. 14 is an end view showing the drum of the alloy powder manufacturing apparatus of FIG. 12, taken along a plane perpendicular to a central axis of the drum and including a second nozzle.

Referring to FIGS. 12 to 14, the alloy powder manufacturing apparatus 10*k* according to the present embodiment comprises a drum 20*k*. The drum 20*k* comprises at least one nozzle 30. This at least one nozzle 30 includes a first nozzle (nozzle) 32 and a second nozzle (nozzle) 34. In other words, the drum 20*k* comprises the two nozzle 30 which are the first nozzle 32 and the second nozzle 34.

The first nozzle 32 is arranged at an upstream side of a position where the molten alloy 60 falls. The second nozzle 34 is arranged at a downstream side of the position where the molten alloy 60 falls. Thus, the coolant liquid supplied from the first nozzle 32 joins the coolant liquid supplied from the second nozzle 34 after passing through the position where the molten alloy 60 falls and thereafter flows downstream toward an exit of the drum 20*k*. Meanwhile, the coolant liquid supplied from the first nozzle 32 forms a first liquid film (liquid film) 52. The coolant liquid supplied from the second nozzle 34 increases the thickness of the first liquid film 52 and forms a second liquid film (liquid film) 54. Thus, the second liquid film 54 is thicker than the first liquid film 52 and has cooling ability higher than that of the first liquid film 52.

The first nozzle 32 supplies a relatively small amount of the coolant liquid which has a large initial velocity, and thereby the relatively thin first liquid film 52 is formed. For example, the coolant liquid supplied from the first nozzle 32 has an initial velocity of 170 m/s or more, and the first liquid film 52 has high ability to divide the molten alloy 60. The first liquid film 52 can form fine particles. On the other hand, the second nozzle 34 supplies a relatively large amount of the coolant liquid which has a relatively small initial velocity, and thereby the thick second liquid film 54 is formed. For example, the second liquid film 54 formed by the coolant liquid supplied from the second nozzle 34 has a thickness of 0.8 mm or more, and the second liquid film 54 has a large heat capacity which can sufficiently cool the fine particles. The fine particles can be sufficiently cooled even in an instance where the supplied amount of the molten alloy 60 is increased so that a large amount of the fine particles are formed.

Theoretically, the nozzle 30 is preferred to supply a large amount of the coolant liquid with a large initial velocity. However, a supplying facility such as an expensive pump is required in order for a large amount of the coolant liquid to be supplied with a large initial velocity. According to the present embodiment, high ability to divide the molten alloy 60 can be obtained by the upstream side first nozzle 32 while a large heat capacity can be obtained by the downstream side second nozzle 34. Thus, according to the present embodiment, a necessary amount of the fine particles can be obtained while increase in manufacturing cost is reduced.

The feature of the first liquid film 52 is not specifically limited, provided that the first nozzle 32 can form the first liquid film 52 from the coolant liquid having a large initial velocity. For example, the liquid film 52 formed by the coolant liquid supplied from the first nozzle 32 may have a thickness thinner than another thickness of the liquid film 54 formed by the coolant liquid supplied from the second nozzle 34. The feature of the coolant liquid supplied by the second nozzle 34 is not specifically limited, provided that the second nozzle 34 can form the second liquid film 54 thicker than the first liquid film 52 from the coolant liquid. For example, the coolant liquid supplied from the second nozzle 34 may have an initial velocity slower than another initial velocity of the coolant liquid supplied from the first nozzle 32.

Figure 15:
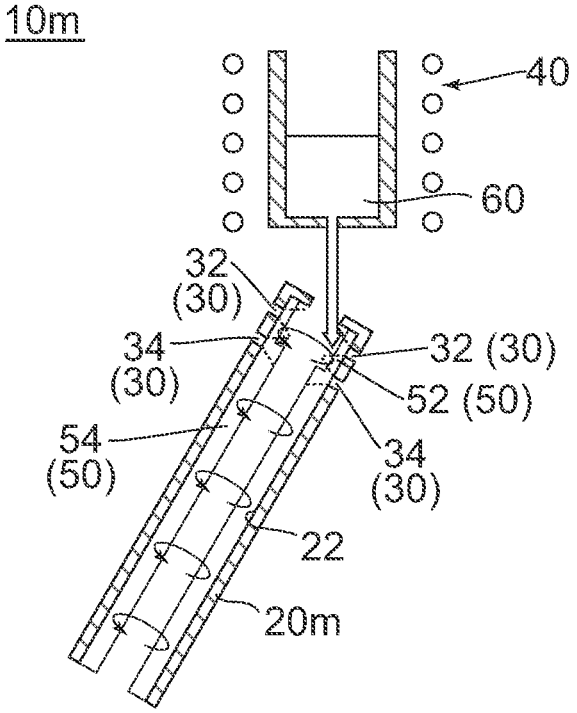
FIG. 15 is a view showing a modification of the alloy powder manufacturing apparatus of FIG. 12.

Referring to FIGS. 12 and 15, an alloy powder manufacturing apparatus 10*m* is a modification of the alloy powder manufacturing apparatus 10*k*. The alloy powder manufacturing apparatus 10*m* comprises a drum 20*m*. The drum 20*m* comprises four of the nozzles 30 consisting of two of the first nozzles 32 and two of the second nozzles 34. According to the present modification, a necessary amount of fine particles can be obtained while increase in manufacturing cost is reduced similarly to the alloy powder manufacturing apparatus 10*k*.

Examples 1 to 19 and Comparative Examples 1 to 3

Alloy powders were manufactured under various conditions shown in Table 1 by using an alloy powder manufacturing apparatus according to an embodiment of the present invention. Table 2 shows evaluation about the obtained alloy powders.

TABLE 1

| | alloy type | inner diameter of drum [mm] | inner diameter of exit [mm] | water velocity [m/s] | acceleration [G] |
|---|---|---|---|---|---|
| Comparative Example 1 | Fe—B—P—Cu | 300 | 300 | 170 | $1.97 \times 10^4$ |
| Example 1 | Fe—B—P—Cu | 100 | 100 | 170 | $5.9 \times 10^4$ |
| Example 2 | Fe—B—P—Cu | 60 | 60 | 170 | $9.83 \times 10^4$ |
| Example 3 | Fe—B—P—Cu | 20 | 20 | 620 | $3.92 \times 10^6$ |
| Example 4 | Fe—B—P—Cu | 40 | 40 | 430 | $9.43 \times 10^5$ |
| Example 5 | Fe—B—P—Cu | 40 | 40 | 280 | $4.00 \times 10^5$ |
| Example 6 | Fe—B—P—Cu | 40 | 40 | 170 | $1.47 \times 10^5$ |
| Example 7 | Fe—B—P—Cu | 10 | 10 | 170 | $5.9 \times 10^5$ |
| Example 8 | Fe—B—P—Cu | 40 | 35 | 120 | $7.35 \times 10^4$ |
| Example 9 | Fe—B—P—Cu | 40 | 35 | 100 | $5.1 \times 10^4$ |
| Example 10 | Fe—B—P—Cu | 40 | 35 | 80 | $3.27 \times 10^4$ |
| Comparative Example 2 | Fe—B—P—Cu | 40 | 35 | 60 | $1.84 \times 10^4$ |
| Example 11 | Fe—B—P—Cu | 60 | 55 | 170 | $9.83 \times 10^4$ |
| Example 12 | Fe—B—P—Cu | 60 | 50 | 170 | $9.83 \times 10^4$ |
| Comparative Example 3 | Fe—B—P—Cu | 60 | 54 | 60 | $1.22 \times 10^4$ |
| Example 13 | Fe—B—P | 40 | 40 | 170 | $1.47 \times 10^5$ |
| Example 14 | Fe—Si—B—P—Cu | 40 | 40 | 170 | $1.47 \times 10^5$ |
| Example 15 | Fe—Si—B—P—Cu—Cr | 40 | 40 | 170 | $1.47 \times 10^5$ |
| Example 16 | Fe—Si—B—Nb—Cr | 40 | 40 | 170 | $1.47 \times 10^5$ |
| Example 17 | Fe—Si—B—Nb—Cu | 40 | 40 | 170 | $1.47 \times 10^5$ |
| Example 18 | Fe—Si—B—Cr | 40 | 40 | 170 | $1.47 \times 10^5$ |
| Example 19 | Fe—B | 40 | 40 | 170 | $1.47 \times 10^5$ |

TABLE 2

| | alloy type | particle diameter (D50) [μm] | crystallinity [%] | particle shape | Hc [Oe] |
|---|---|---|---|---|---|
| Comparative Example 1 | Fe—B—P—Cu | 150 | 12 | irregular | 14 |
| Example 1 | Fe—B—P—Cu | 50 | 4.2 | almost sphere | 5 |
| Example 2 | Fe—B—P—Cu | 43 | 1.6 | almost sphere | 1 |
| Example 3 | Fe—B—P—Cu | 8 | 0.2 | almost sphere | 1 |
| Example 4 | Fe—B—P—Cu | 12 | 1.0 | almost sphere | 1 |
| Example 5 | Fe—B—P—Cu | 18 | 0.8 | sphere | 1 |
| Example 6 | Fe—B—P—Cu | 22 | 1 | sphere | 1 |
| Example 7 | Fe—B—P—Cu | 10 | 0.3 | sphere | 2 |
| Example 8 | Fe—B—P—Cu | 41 | 0.7 | sphere | 1 |
| Example 9 | Fe—B—P—Cu | 48 | 1.5 | almost sphere | 2 |
| Example 10 | Fe—B—P—Cu | 85 | 3.9 | almost sphere | 7 |
| Comparative Example 2 | Fe—B—P—Cu | 115 | 5.7 | irregular | 12 |
| Example 11 | Fe—B—P—Cu | 50 | 1.0 | sphere | 1 |
| Example 12 | Fe—B—P—Cu | 77 | 2.8 | sphere | 3 |
| Comparative Example 3 | Fe—B—P—Cu | 99 | 5.7 | irregular | 14 |
| Example 13 | Fe—B—P | 18 | 0.0 | sphere | 1 |
| Example 14 | Fe—Si—B—P—Cu | 23 | 0.8 | almost sphere | 1 |
| Example 15 | Fe—Si—B—P—Cu—Cr | 21 | 0.0 | sphere | 1 |
| Example 16 | Fe—Si—B—Nb—Cr | 19 | 1.6 | almost sphere | 1 |
| Example 17 | Fe—Si—B—Nb—Cu | 26 | 0.0 | almost sphere | 1 |
| Example 18 | Fe—Si—B—Cr | 24 | 0.0 | almost sphere | 1 |
| Example 19 | Fe—B | 18 | 0.0 | sphere | 1 |

Referring to Tables 1 and 2, when the inner diameter of the drum is more than 100 mm as shown in Comparative Example 1, the particles have irregular shapes and have undesirable characteristics. Moreover, when the initial velocity of the coolant liquid is less than 80 m/s as shown in Comparative Examples 2 and 3, the particles have irregular shapes and have undesirable characteristics. In contrast, the particles of Examples 1 to 19 have spere shapes or almost sphere shapes and have good amorphous feature. In addition, the particles of Examples 1 to 19 have good characteristics such as small coercivity.

In Examples 8 to 12, the inner diameter of the exit of the drum was made smaller than the inner diameter of the drum. When the inner diameter of the exit of the drum is made smaller than the inner diameter of the drum, the exit is formed with a barrier, and thereby the coolant liquid can be adjusted so that the thickness thereof is made thicker. The particle diameter can be controlled by this adjustment. For example, in a situation in which manufacture of the particles having large particle diameters is required, a relatively thick liquid film is necessary since a relatively long cooling time is necessary. As shown in Examples 8 to 12, the inner diameter of the exit of the drum should be smaller than the inner diameter of the drum in order for the relatively thick liquid film to be formed.

The present application is based on a Japanese patent application of JP2021-112002 filed before the Japan Patent Office on Jul. 6, 2021, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10, 10*a*, 10*b*, 10*c*, 10*d*, 10*e*, 10*f*, 10*g*, 10*h*, 10*i*, 10*j*, 10*k*, 10*m* alloy powder manufacturing apparatus
12 base portion
20*a*, 20*b*, 20*d*, 20*e*, 20*f*, 20*h*, 20*i*, 20*j*, 20*k*, 20*m* drum
22 inner wall
24 exit cover
30 nozzle
32 first nozzle (nozzle)
34 second nozzle (nozzle)
35 scatter prevention portion (scatter prevention cylinder)
40 alloy supplying portion
50 liquid film
52 first liquid film (liquid film)
54 second liquid film (liquid film)
PT predetermined thickness
60 molten alloy

The invention claimed is:

1. An alloy powder manufacturing apparatus comprising:
a base portion comprising an inner wall of a drum, at least a portion of the inner wall having curvature with a curvature radius of 100 mm or less;
at least one nozzle;
at least one alloy supplying portion; and an exit cover provided at an exit of the drum and including an opening having an inner diameter smaller than an inner diameter of the drum, the exit of the drum being provided at an end of the drum in a longitudinal direction of the drum, wherein:

the nozzle is configured to supply flowing fluid made of coolant liquid onto the base portion and form a liquid film with a predetermined thickness thereon so that a predetermined acceleration is applied to the liquid film along a thickness direction, the predetermined acceleration being a centrifugal acceleration generated by the curvature of the inner wall and directed toward the inner wall;

the alloy supplying portion is configured to supply molten alloy to the flowing fluid at an upstream side of the portion having the curvature, without dividing the molten alloy; and the flowing fluid divides the molten alloy into a size equal to or less than the predetermined thickness to form particles therefrom, whereby the predetermined acceleration keeps the particles in the liquid film so that the particles are continuously in contact with and cooled by the flowing fluid.

2. The alloy powder manufacturing apparatus as recited in claim 1, wherein the inner diameter of the drum is 10 mm or more and 100 mm or less.

3. The alloy powder manufacturing apparatus as recited in claim 1, wherein the inner diameter of the drum is 20 mm or more and 60 mm or less.

4. The alloy powder manufacturing apparatus as recited in claim 1, wherein:

the alloy powder manufacturing apparatus further comprises a scatter prevention portion; and the scatter prevention portion surrounds at least the exit of the drum and catches particles discharged from the drum.

5. The alloy powder manufacturing apparatus as recited in claim 1, wherein:

the coolant liquid supplied from the nozzle has an initial velocity of 80 m/s or more;

the predetermined acceleration is $2.0\times10^4$ G or more and $1.0\times10^7$ G or less; and the predetermined thickness is 0.1 mm or more.

6. The alloy powder manufacturing apparatus as recited in claim 1, wherein:

the coolant liquid supplied from the nozzle has an initial velocity of 100 m/s or more;

the predetermined acceleration is $2.0\times10^4$ G or more and $1.0\times10^7$ G or less; and the predetermined thickness is 0.1 mm or more.

7. The alloy powder manufacturing apparatus as recited in claim 1, wherein the alloy supplying portion is arranged so that the alloy supplying portion supplies the molten alloy to the liquid film along a direction which makes an angle which is 10° or more but is 90° or less relative to the liquid film.

8. The alloy powder manufacturing apparatus as recited in claim 1, wherein the alloy supplying portion is arranged so that the alloy supplying portion supplies the molten alloy only to a predetermined area which is located on the liquid film and has a diameter of 15 mm or less.

9. The alloy powder manufacturing apparatus as recited in claim 1, wherein a maximum distance from the alloy supplying portion to the liquid film is 300 mm or less.

10. The alloy powder manufacturing apparatus as recited in claim 1, wherein the at least one alloy supplying portion includes a plurality of alloy supplying portions.

11. The alloy powder manufacturing apparatus as recited in claim 1, wherein the coolant liquid has a velocity of 40 m/s or more at a position where the molten alloy falls.

12. The alloy powder manufacturing apparatus as recited in claim 1, wherein:

the at least one nozzle includes a first nozzle and a second nozzle;

the first nozzle is arranged at an upstream side of a position where the molten alloy falls;

the second nozzle is arranged at a downstream side of a position where the molten alloy falls;

the coolant liquid supplied from the first nozzle has an initial velocity of 170 m/s or more; and the liquid film formed by the coolant liquid supplied from the second nozzle has a thickness of 0.8 mm or more.

13. The alloy powder manufacturing apparatus as recited in claim 5, wherein the predetermined acceleration is $3.0\times10^4$ G or more and $1.0\times10^7$ G or less.

14. The alloy powder manufacturing apparatus as recited in claim 5, wherein the predetermined thickness is 0.8 mm or more.

15. The alloy powder manufacturing apparatus as recited in claim 12, wherein:

the liquid film formed by the coolant liquid supplied from the first nozzle has a thickness thinner than another thickness of the liquid film formed by the coolant liquid supplied from the second nozzle; and the coolant liquid supplied from the second nozzle has an initial velocity slower than another initial velocity of the coolant liquid supplied from the first nozzle.

* * * * *